US011744326B1

(12) United States Patent
Avila

(10) Patent No.: US 11,744,326 B1
(45) Date of Patent: Sep. 5, 2023

(54) TOE GUARD ASSEMBLY

(71) Applicant: Richard Avila, Alhambra, CA (US)

(72) Inventor: Richard Avila, Alhambra, CA (US)

( * ) Notice: Subject to any disclaimer, the term of this patent is extended or adjusted under 35 U.S.C. 154(b) by 0 days.

(21) Appl. No.: 17/840,214

(22) Filed: Jun. 14, 2022

(51) Int. Cl.
*A43B 23/08* (2006.01)
*A43B 3/18* (2022.01)
*A43C 13/14* (2006.01)

(52) U.S. Cl.
CPC ..... *A43B 23/081* (2013.01); *A43B 3/18* (2013.01); *A43C 13/14* (2013.01)

(58) Field of Classification Search
CPC ..... A43C 13/14; A43C 11/00; A43B 23/081
See application file for complete search history.

(56) References Cited

U.S. PATENT DOCUMENTS 461,492 A * 10/1891 Browning ..... A43B 7/32 D2/913
745,442 A * 12/1903 Innes ..... A43B 3/0031 36/1
756,198 A * 4/1904 Adams ..... A43B 7/32 36/72 R
820,250 A * 5/1906 Patterson ..... A43B 7/32 36/72 R
1,030,892 A * 7/1912 Kennedy ..... A43B 7/32 36/72 R
1,640,669 A * 8/1927 Sankey ..... A43C 13/14 36/72 R
1,717,438 A * 6/1929 Dickson ..... A43C 13/14 36/72 R
1,742,763 A * 1/1930 Gerard ..... A43C 13/14 36/72 R
2,160,768 A * 5/1939 Wasser ..... A43C 13/14 36/72 R
2,268,435 A * 12/1941 Zucker ..... A43C 13/14 36/7.5
2,344,069 A * 3/1944 Wasser ..... A43C 13/14 36/72 R
3,271,888 A * 9/1966 Graham ..... A43C 13/14 D2/913
3,421,234 A * 1/1969 Sargent ..... A43C 13/14 36/72 R
3,497,972 A 3/1970 Lyman
3,716,932 A * 2/1973 Pakulak ..... A43B 7/32 36/7.5
4,005,534 A * 2/1977 Crist ..... A43C 13/14 36/72 R
4,069,599 A * 1/1978 Alegria ..... A43B 3/20 36/106
4,638,574 A * 1/1987 Roda ..... A43B 3/20 36/7.2
4,780,970 A * 11/1988 McArthur, Sr. ..... A43B 3/20 36/72 R (Continued)

*Primary Examiner* — Jillian K Pierorazio

(57) ABSTRACT

A toe guard assembly includes a cup that is elongated to insertably receive a toe of an article of footwear. The cup is comprised of a rigid material to protect the toe from impact energy. Each of a pair of engagements extends away from the cup and the engagements are positioned on opposing sides of the cup from each other. A belt is coupled to a respective one of the engagements on the cup and the belt can be extended around a heel of the article of footwear. The belt is releasably matable to a respective one of the engagement to retain the cup on the toe of the article of footwear.

4 Claims, 6 Drawing Sheets

(56) References Cited

U.S. PATENT DOCUMENTS

| | | | | | |
|---|---|---|---|---|---|
| 4,967,493 | A | | 11/1990 | Mues | |
| 4,991,318 | A | * | 2/1991 | Cornell | A43B 3/20 36/72 R |
| D378,470 | S | * | 3/1997 | McDaniel | D2/909 |
| 5,638,614 | A | * | 6/1997 | Hardy | A43B 3/16 36/7.1 R |
| 5,996,258 | A | * | 12/1999 | Simmons | A43B 5/145 36/7.1 R |
| D435,715 | S | * | 1/2001 | Hunter | D2/913 |
| D470,647 | S | * | 2/2003 | Johnson | D2/913 |
| 6,560,781 | B1 | | 5/2003 | Keene | |
| D489,518 | S | * | 5/2004 | Maxfield | D2/919 |
| 6,886,275 | B1 | * | 5/2005 | Westfall | A43B 3/20 36/77 R |
| D697,290 | S | * | 1/2014 | Langel | D2/913 |
| 2004/0049949 | A1 | | 3/2004 | Valentini | |
| 2005/0066551 | A1 | * | 3/2005 | Evans | A43B 3/16 36/131 |
| 2012/0060389 | A1 | | 3/2012 | Mille | |
| 2012/0117821 | A1 | * | 5/2012 | Adams | A43B 3/0052 36/58.5 |
| 2018/0177262 | A1 | * | 6/2018 | Islas Mares | A43B 3/24 |

* cited by examiner

TOE GUARD ASSEMBLY

CROSS-REFERENCE TO RELATED APPLICATIONS

Not Applicable

(c) STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to toe guard devices and more particularly pertains to a new toe guard device for protecting a toe of an article of footwear from impact energy. The device includes a cup, comprised of a rigid material, that is worn on a toe of an article of footwear. The device includes a belt, attached to the cup, that is extendable around a heel of the article of footwear for securing the cup on the toe.

(2) Description of Related Art Including Information Disclosed Under 37 CFR 1.97 and 1.98

The prior art relates to toe guard devices including a shoe overlay device that is positionable on a toe of a shoe and which includes an eyelet for receiving a shoelace. The prior art discloses a baseball shoe protector which includes a lower shell for receiving a toe of a baseball shoe and an upper shell which extends toward an ankle of the baseball shoe. The prior art discloses a shoe protector which includes a cup for receiving a toe of a shoe and which has a breakaway hook integrated into the cup for engaging a shoelace. The prior art discloses a variety of toe protectors that each includes a cup that is wearable on a toe of a shoe and a strap that is fixed to the cup for extending around a heel of the shoe. The prior art discloses a shoe protector that includes a ventilated cup that is wearable on a toe of a shoe and a strap that is irremovably attached to the cup.

BRIEF SUMMARY OF THE INVENTION

An embodiment of the disclosure meets the needs presented above by generally comprising a cup that is elongated to insertably receive a toe of an article of footwear. The cup is comprised of a rigid material to protect the toe from impact energy. Each of a pair of engagements extends away from the cup and the engagements are positioned on opposing sides of the cup from each other. A belt is coupled to a respective one of the engagements on the cup and the belt can be extended around a heel of the article of footwear. The belt is releasably matable to a respective one of the engagement to retain the cup on the toe of the article of footwear.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
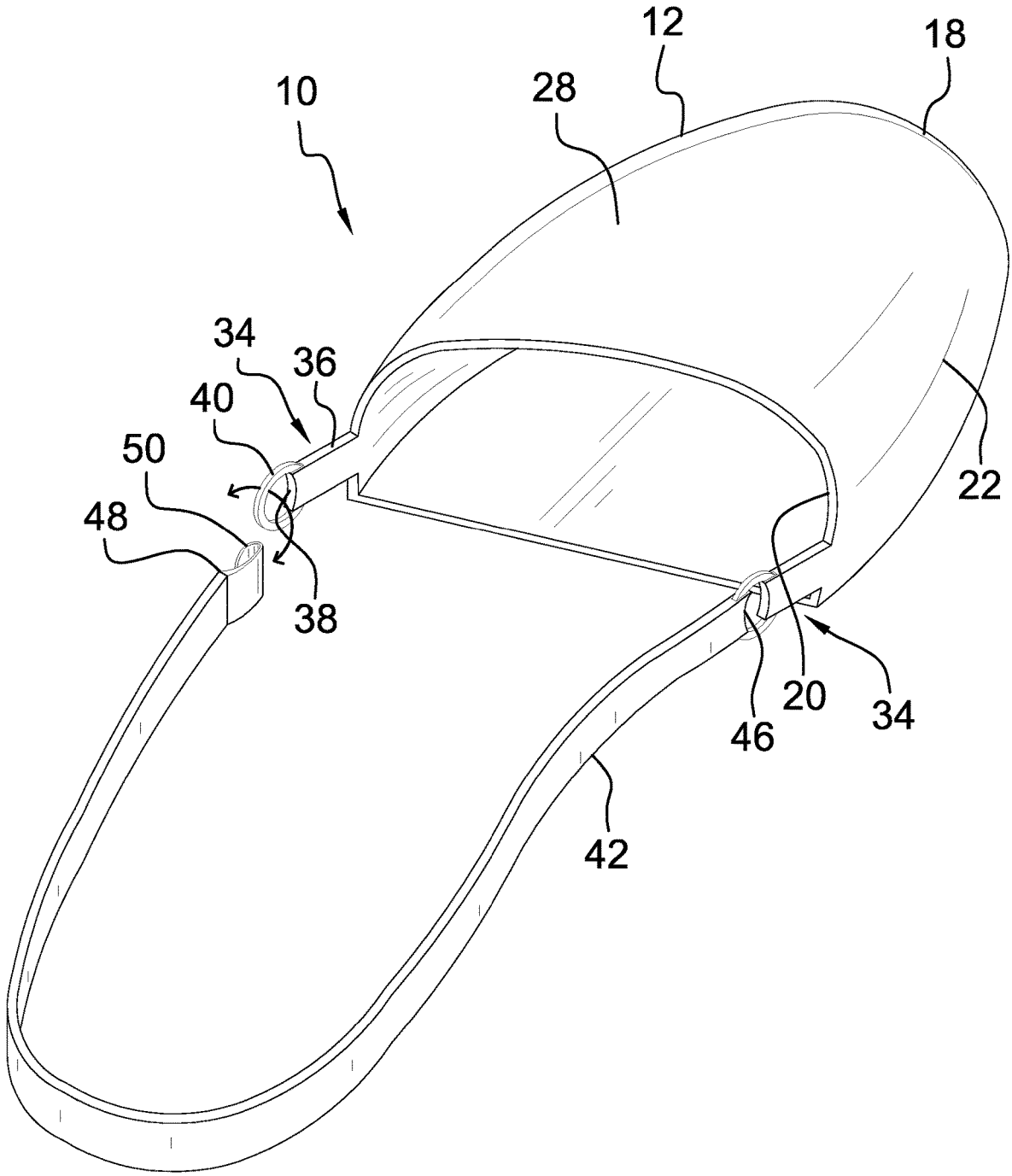
FIG. 1 is a top perspective view of a toe guard assembly according to an embodiment of the disclosure.
Figure 2:
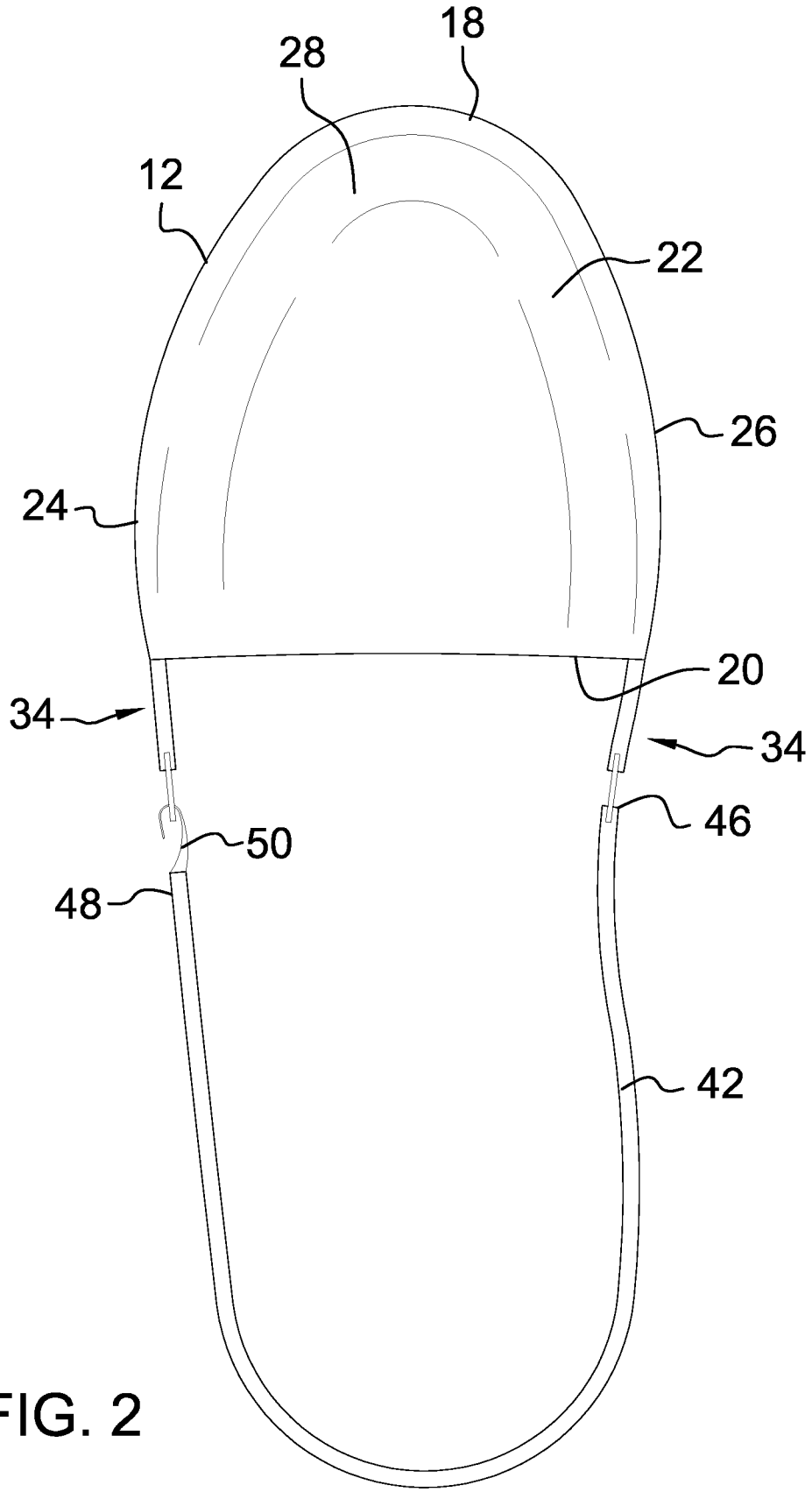
FIG. 2 is a top view of an embodiment of the disclosure.
Figure 3:
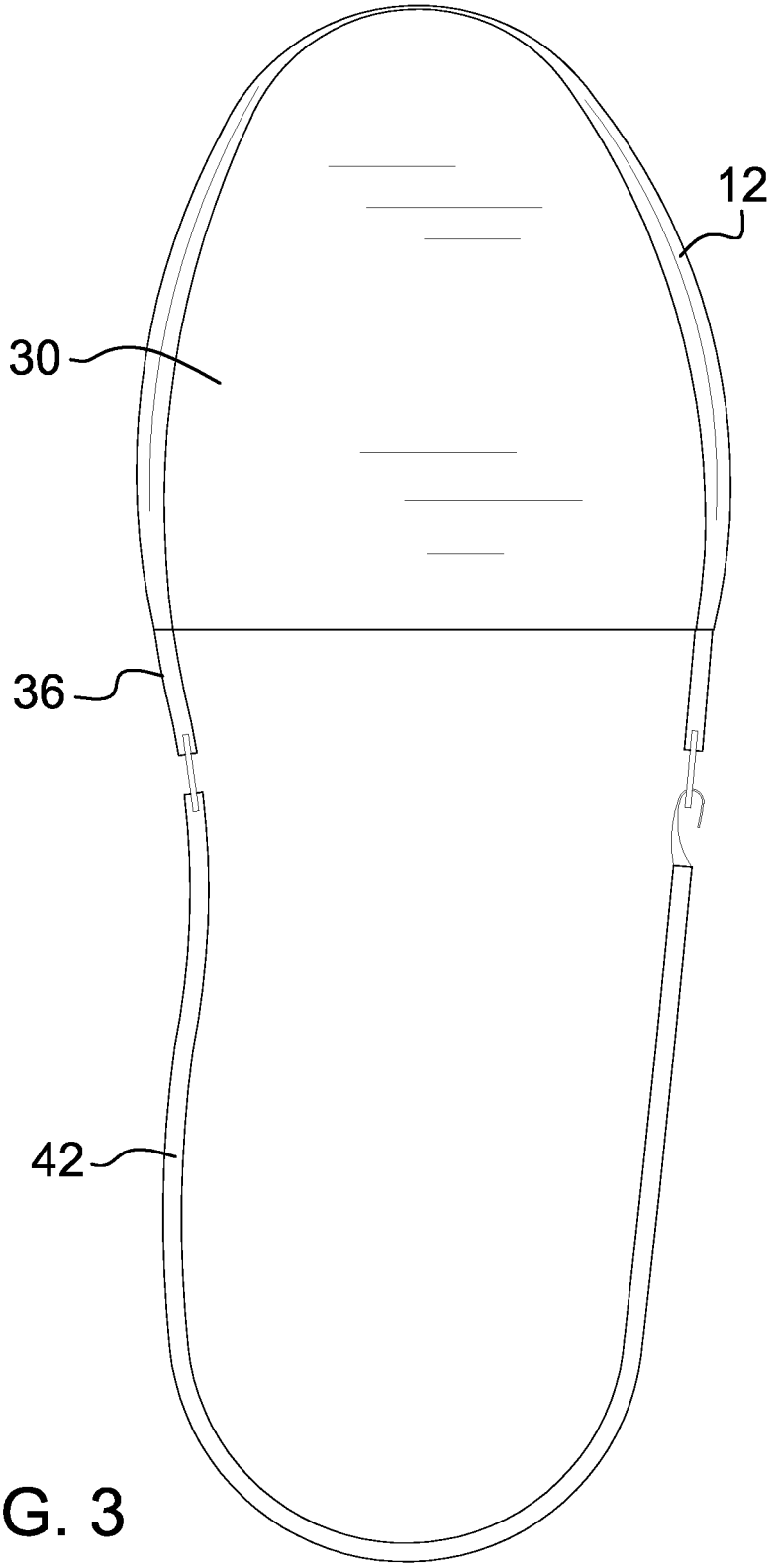
FIG. 3 is a bottom view of an embodiment of the disclosure.
Figure 4:
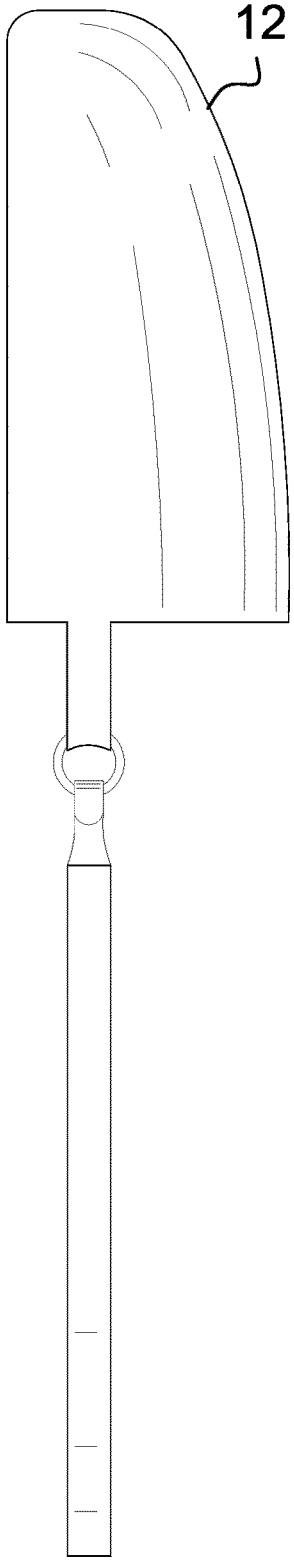
FIG. 4 is a left side view of an embodiment of the disclosure.
Figure 5:
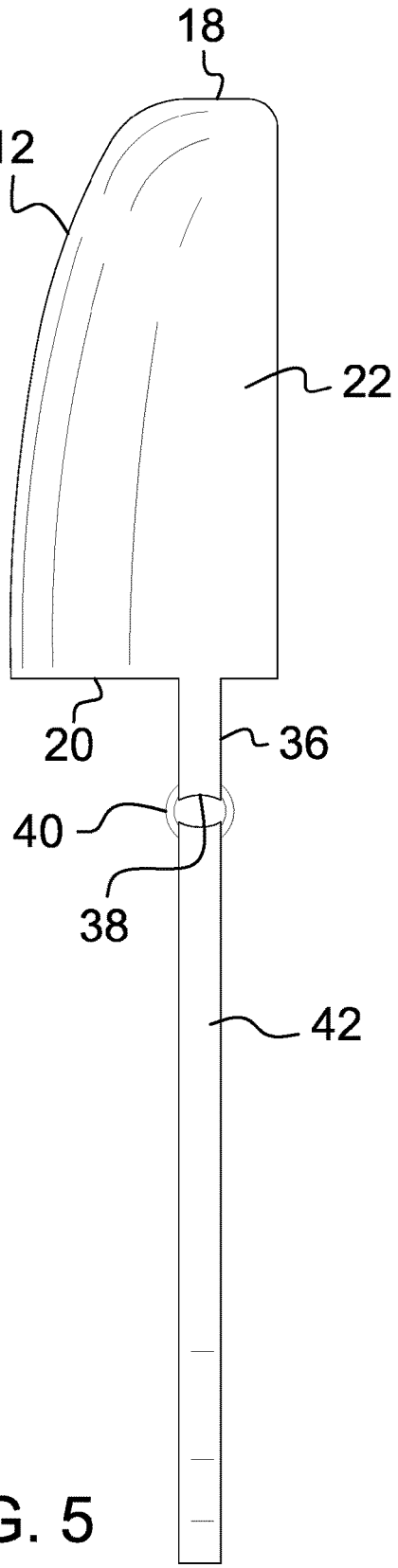
FIG. 5 is a right side view of an embodiment of the disclosure.
Figure 6:
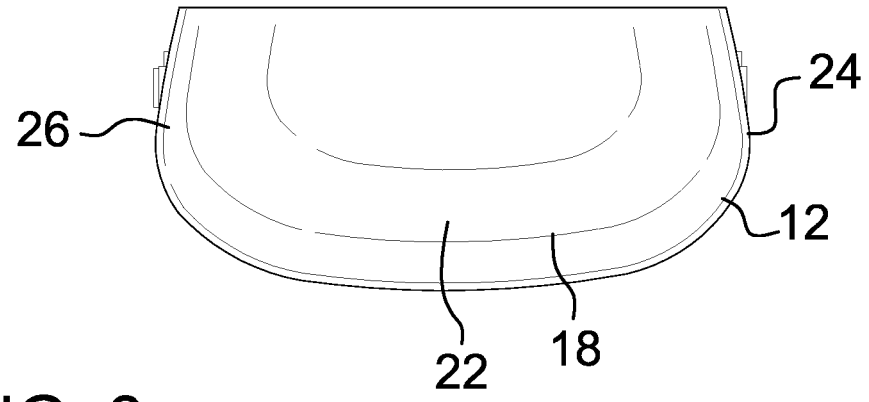
FIG. 6 is a front view of an embodiment of the disclosure.
Figure 7:
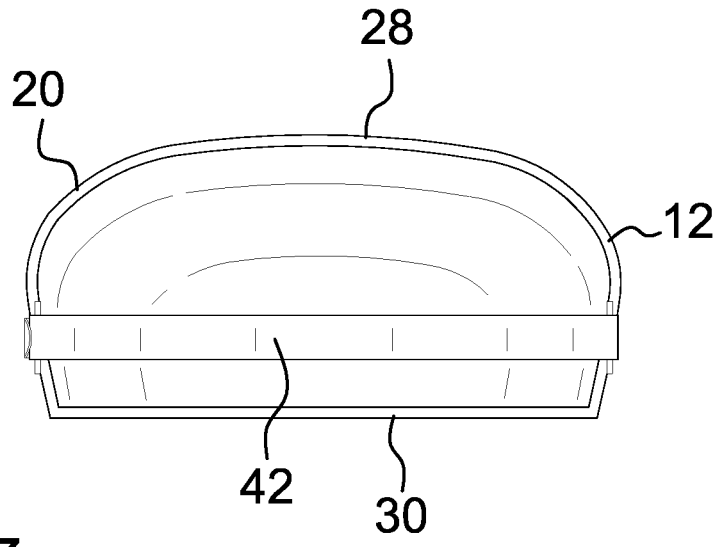
FIG. 7 is a back view of an embodiment of the disclosure.
Figure 8:
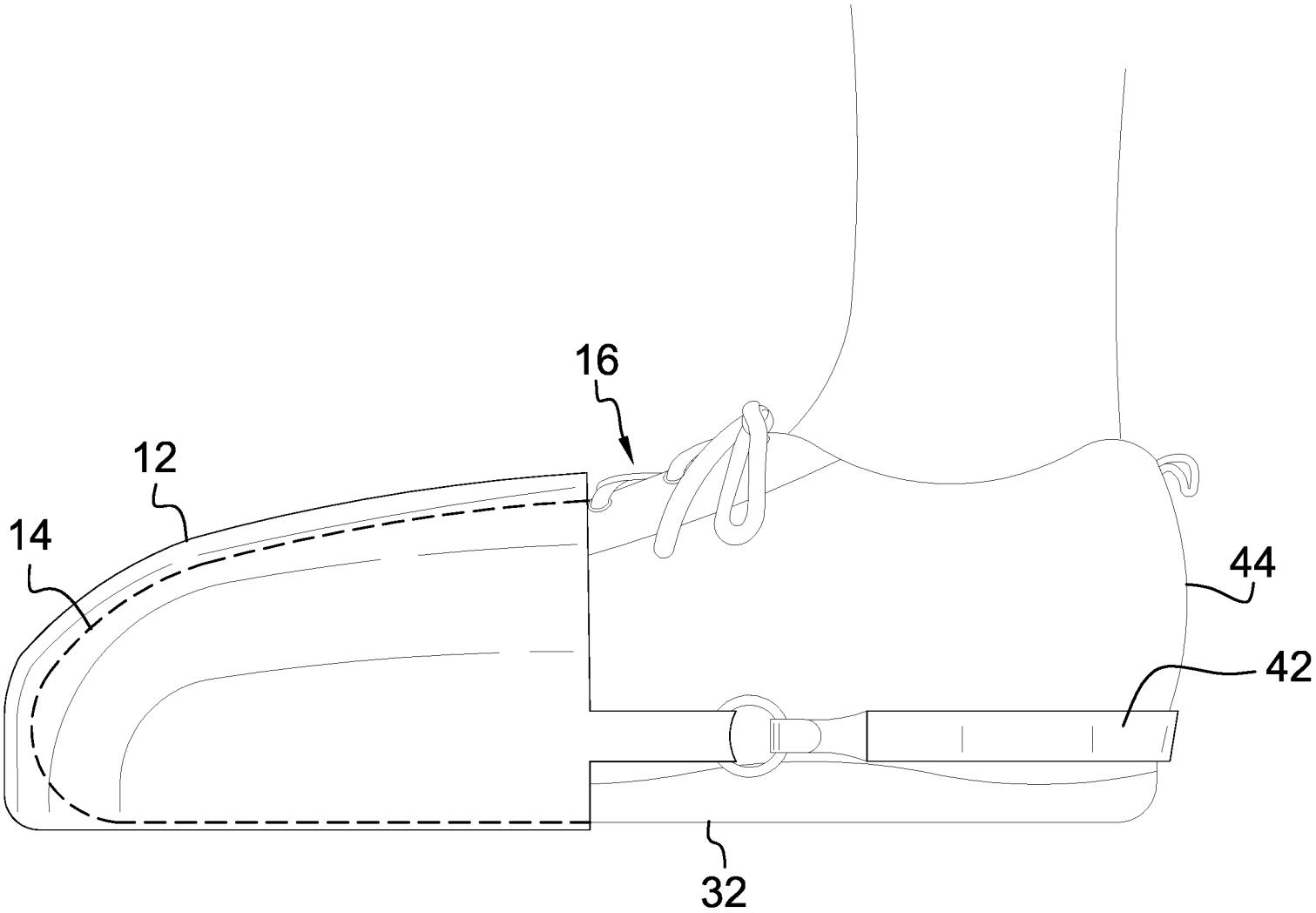
FIG. 8 is a perspective in-use view of an embodiment of the disclosure.

With reference now to the drawings, and in particular to FIGS. 1 through 8 thereof, a new toe guard device embodying the principles and concepts of an embodiment of the disclosure and generally designated by the reference numeral 10 will be described.

As best illustrated in FIGS. 1 through 8, the toe guard assembly 10 generally comprises a cup 12 that is elongated to insertably receive a toe 14 of an article of footwear 16. The article of footwear 16 may be a tennis shoe or other type of shoe that might be worn by a baseball umpire or a baseball catcher. The cup 12 is comprised of a rigid material, including but not being limited to, acrylonitrile butadiene styrene or polyvinyl chloride, to protect the toe 14 from impact energy. In this way the baseball umpire or the baseball catcher are protected from being injured due to being struck on the toe 14 by a baseball.

The cup 12 has a front end 18, a back end 20 and an outer wall 22 extending between the front end 18 and the back end 20; the back end 20 is open to insertably receive the toe 14 and the front end 18 is rounded to conform to the toe 14. The outer wall 22 has a first lateral side 24, a second lateral side 26, a top side 28 and a bottom side 30; the bottom side 30 is flattened to conform to a sole 32 of the article of footwear 16 and the top side 28 is convexly arcuate with respect to the bottom side 30 to conform to curvature of the article of footwear 16. The back end 20 is elongated between the first lateral side 24 and the second lateral side 26 such that the back end 20 has an ovoid shape to conform to the profile of the article of footwear 16. The cup 12 has a pair of engagements 34 each extending away from the cup 12 and the engagements 34 are positioned on opposing sides of the cup 12 from each other.

Each of the engagements 34 comprises a strap 36 extending away from the back end 20 of the cup 12. The strap 36 has a distal end 38 with respect to the back end 20 and the strap 36 associated with each of the engagements 34 is aligned with a respective one of the first lateral side 24 and the second lateral side 26 of the outer wall 22 of the cup 12. Each of the engagements 34 includes a ring 40 that is integrated into the strap 36 and the ring 40 is positioned adjacent to the distal end 38 of the strap 36.

A belt 42 is coupled to a respective one of the engagements 34 on the cup 12 and the belt 42 can be extended around a heel 44 of the article of footwear 16. The belt 42 is releasably matable to a respective one of the engagements 34 to retain the cup 12 on the toe 14 of the article of footwear 16. The belt 42 has a first end 46 and a second end 48, and the first end 46 is movably coupled to the ring 40 associated with a respective one of the engagements 34. A closure 50 is coupled to the second end 48 of the belt 42 and the closure 50 engages the ring 40 associated with a respective one of the engagements 34. Furthermore, the closure 50 is manipulatable into releasing condition for disengaging the ring 40 associated with the respective engagement 34. The closure 50 might comprise a hook, a claps or any other type of releasable, mechanical closure.

In use, the cup 12 is worn on the toe 14 of the article of footwear 16, the belt 42 is extended around the heel 44 of the article of footwear 16 and the closure 50 is attached to the respective engagement 34. In this way the cup 12 is retained on the toe 14 of the article of footwear 16 to protect the toe 14 from impact energy. Thus, a baseball umpire or a baseball catcher are protected from being injured by a baseball that strikes the toe 14. Furthermore, the cup 12 and the belt 42 facilitate a lower cost solution for impact protection as compared to steel toed baseball shoes, for example.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toe guard assembly for protecting a toe of a shoe from impact, said assembly comprising:

a cup being elongated wherein said cup is configured to insertably receive a toe of an article of footwear, said cup being comprised of a rigid material wherein said cup is configured to protect the toe from impact energy, said cup having a pair of engagements each extending away from said cup, said engagements being positioned on opposing sides of said cup from each other, said cup having a front end, a back end and an outer wall extending between said front end and said back end, said back end being open wherein said back end is configured to insertably receive the toe, said outer wall having a first lateral side, a second lateral side, a top side and a bottom side; and a belt, said belt having a first end and a second end, said belt being coupled to a respective one of said engagements on said cup wherein said belt is configured to be extended around a heel of the article of footwear, said belt being releasably matable to an associated first one of said engagements wherein said belt is configured to retain said cup on the toe of the article of footwear;

wherein each of said engagements comprises a strap extending away from said back end of said cup, said strap having a distal end with respect to said back end, said strap associated with each of said engagements being aligned with a respective one of said first lateral side and said second lateral side of said outer wall of said cup, and a ring being integrated into said strap, said ring being positioned adjacent to said distal end of said strap; and a closure being coupled to said second end of said belt, said closure engaging said ring, said closure being manipulatable into releasing condition for disengaging said ring of said associated second one of said engagements, said closure being a hook, said hook being curved laterally outward wherein a distal end of said hook is positioned outwardly of said ring of said associated second one of said engagements when said hook is engaged to said ring of said associated second one of said engagements wherein said hook is configured for having a smooth shaft of said hook positioned between said ring of said associated second one of said engagements and the article of footwear.

2. The assembly according to claim 1, wherein:

said front end being rounded wherein said front end is configured to conform to the toe; and said bottom side is flattened wherein said bottom side is configured to conform to a sole of the article of footwear, said top side being convexly arcuate with respect to said bottom side wherein said top side is configured to conform to curvature of the article of footwear, said back end being elongated between said first lateral side and said second lateral side such that said back end has an ovoid shape wherein said back end is configured to conform to the profile of the article of footwear.

3. A toe guard assembly for protecting a toe of a shoe from impact, said assembly comprising:

a cup being elongated wherein said cup is configured to insertably receive a toe of an article of footwear, said cup being comprised of a rigid material wherein said cup is configured to protect the toe from impact energy, said cup having a front end, a back end and an outer wall extending between said front end and said back end, said back end being open wherein said back end is configured to insertably receive the toe, said front end being rounded wherein said front end is configured to conform to the toe, said outer wall having a first lateral side, a second lateral side, a top side and a bottom side, said bottom side being flattened wherein said bottom side is configured to conform to a sole of the article of footwear, said top side being convexly arcuate with respect to said bottom side wherein said top side is configured to conform to curvature of the article of footwear, said back end being elongated between said first lateral side and said second lateral side such that said back end has an ovoid shape wherein said back end is configured to conform to the profile of the article of footwear, said cup having a pair of engagements each extending away from said cup, said engagements being positioned on opposing sides of said cup from each other, each of said engagements comprising:

a strap extending away from said back end of said cup, said strap having a distal end with respect to said back end, said strap associated with each of said engagements being aligned with a respective one of said first lateral side and said second lateral side of said outer wall of said cup; and a ring being integrated into said strap, said ring being positioned adjacent to said distal end of said strap;

a belt being coupled to an associated first one of said engagements on said cup wherein said belt is configured to be extended around a heel of the article of footwear, said belt being releasable matable to an associated second one of said engagements wherein said belt is configured to retain said cup on the toe of the article of footwear, said belt having a first end and a second end, said first end being movably coupled to said ring of said associated first one of said engagements; and a closure being coupled to said second end of said belt, said closure engaging said ring of said associated second one of said engagements, said closure being manipulatable into releasing condition for disengaging said ring of said associated second one of said engagements, said closure being a hook, said hook being curved laterally outward wherein a distal end of said hook is positioned outwardly of said ring of said associated second one of said engagements when said hook is engaged to said ring of said associated second one of said engagements wherein said hook is configured for having a smooth shaft of said hook positioned between said ring of said associated second one of said engagements and the article of footwear.

4. A toe guard system for protecting a toe of a shoe from impact, said system comprising:

an article of footwear having a toe, a heel and a sole;

a cup being elongated to insertably receive said toe of said article of footwear, said cup being comprised of a rigid material wherein said cup is configured to protect said toe from impact energy, said cup having a front end, a back end and an outer wall extending between said front end and said back end, said back end being open to insertably receive said toe, said front end being rounded to conform to said toe, said outer wall having a first lateral side, a second lateral side, a top side and a bottom side, said bottom side being flattened to conform to said sole of said article of footwear, said top side being convexly arcuate with respect to said bottom side to conform to curvature of said article of footwear, said back end being elongated between said first lateral side and said second lateral side such that said back end has an ovoid shape to conform to the profile of said article of footwear, said cup having a pair of engagements each extending away from said cup, said engagements being positioned on opposing sides of said cup from each other, each of said engagements comprising:

a strap extending away from said back end of said cup, said strap having a distal end with respect to said back end, said strap associated with each of said engagements being aligned with a respective one of said first lateral side and said second lateral side of said outer wall of said cup; and a ring being integrated into said strap, said ring being positioned adjacent to said distal end of said strap;

a belt being coupled to an associated first one of said engagements on said cup wherein said belt is configured to be extended around a heel of the article of footwear, said belt being releasable matable to an associated second one of said engagements wherein said belt is configured to retain said cup on the toe of the article of footwear, said belt having a first end and a second end, said first end being movably coupled to said ring of said associated first one of said engagements; and a closure being coupled to said second end of said belt, said closure engaging said ring of said associated second one of said engagements, said closure being manipulatable into releasing condition for disengaging said ring of said associated second one of said engagements, said closure being a hook, said hook being curved laterally outward wherein a distal end of said hook is positioned outwardly of said ring of said associated second one of said engagements when said hook is engaged to said ring of said associated second one of said engagements wherein said hook is positioned between said ring of said associated second one of said engagements and the article of footwear.

* * * * *